US011577414B2

(12) United States Patent
Buck, Jr.

(10) Patent No.: US 11,577,414 B2
(45) Date of Patent: Feb. 14, 2023

(54) HAIR CLIPPER WITH PIVOTING BLADESET FOR ENHANCED USER VISIBILITY

(71) Applicant: WAHL CLIPPER CORPORATION, Sterling, IL (US)

(72) Inventor: Robert N. Buck, Jr., Rock Falls, IL (US)

(73) Assignee: WAHL CLIPPER CORPORATION, Sterling, IL (US)

( * ) Notice: Subject to any disclaimer, the term of this patent is extended or adjusted under 35 U.S.C. 154(b) by 58 days.

(21) Appl. No.: 17/205,363

(22) Filed: Mar. 18, 2021

(65) Prior Publication Data

US 2021/0291389 A1 Sep. 23, 2021

Related U.S. Application Data

(60) Provisional application No. 62/991,366, filed on Mar. 18, 2020.

(51) Int. Cl.
*B26B 19/06* (2006.01)
*B26B 19/38* (2006.01)

(52) U.S. Cl.
CPC ..... *B26B 19/063* (2013.01); *B26B 19/3846* (2013.01)

(58) Field of Classification Search
CPC ..... B26B 19/063
See application file for complete search history.

(56) References Cited

U.S. PATENT DOCUMENTS 4,688,329 A * 8/1987 Oord ..... B26B 19/146 30/527
5,579,581 A 12/1996 Melton
5,606,799 A 3/1997 Melton
5,970,616 A 10/1999 Wahl et al.
6,505,404 B2 * 1/2003 Ullmann ..... B26B 19/063 30/223
8,151,466 B2 * 4/2012 Putzer ..... B26B 19/10 30/527
8,677,627 B2 3/2014 Li et al.
2002/0000043 A1 1/2002 Beutel et al.
2002/0162226 A1 * 11/2002 Abraham ..... B26B 19/3853 30/527

(Continued)

FOREIGN PATENT DOCUMENTS

EP 3 907 046 A1 * 11/2021

OTHER PUBLICATIONS

International Search Report and Written Opinion received for PCT/US2021/022919, dated Jun. 3, 2021.

*Primary Examiner* — Hwei-Siu C Payer

(74) *Attorney, Agent, or Firm* — Greer, Burns & Crain, Ltd

(57) ABSTRACT

A hair clipper configured for enhanced user visibility is provided, including a clipper housing defining a longitudinal axis and a cutting end, a clipper bladeset operationally connected to the cutting end and including a stationary blade and a moving blade configured for reciprocating laterally relative to the stationary blade, a drive system projecting from the cutting end and operationally connected to the bladeset for reciprocating the moving blade relative to the stationary blade, at least one bladeset pivot support projecting from the cutting end and connected to the bladeset; the pivot support defining a pivot axis extending transverse to the longitudinal axis.

14 Claims, 6 Drawing Sheets

(56) References Cited

U.S. PATENT DOCUMENTS

| | | | | |
|---|---|---|---|---|
| 2007/0119059 | A1 | 5/2007 | Leventhal | |
| 2008/0155834 | A1 | 7/2008 | Li et al. | |
| 2008/0172885 | A1 | 7/2008 | Morisugi et al. | |
| 2008/0295340 | A1* | 12/2008 | Carlucci | B26B 19/3853 30/199 |
| 2008/0301948 | A1* | 12/2008 | Kostner | B26B 19/063 30/527 |
| 2011/0131812 | A1* | 6/2011 | Erndt | B26B 19/063 30/34.1 |
| 2012/0240414 | A1* | 9/2012 | Wevers | B26B 19/063 30/201 |
| 2021/0291389 | A1* | 9/2021 | Buck, Jr. | B26B 19/3846 |
| 2021/0291390 | A1* | 9/2021 | Davignon | B26B 19/3846 |

* cited by examiner

HAIR CLIPPER WITH PIVOTING BLADESET FOR ENHANCED USER VISIBILITY

RELATED APPLICATION

The present application claims the benefit under 35 USC 119(e) of U.S. Provisional Application No. 62/991,366 filed Mar. 18, 2020, the entire contents of which are incorporated by reference herein.

BACKGROUND

The present invention relates generally to powered hair cutting appliances, namely hair clippers and hair trimmers, and more specifically to powered hair cutting appliances with bladesets that are pivotable relative to a main housing.

Powered hair cutting appliances, more specifically hair clippers and hair trimmers (here collectively referred to as "hair clippers") are well known in the art, for both cutting and styling hair, and also for trimming edges of a person's hairline to achieve a relatively sharply defined edge. Such devices are used by professional hair stylists and barbers, and also by consumers to trim ones' own hair, or the hair of others.

A common drawback of conventional hair clippers, is that when cutting a person's hair to achieve fine edging or detailing, it becomes difficult for the stylist, whether or not a professional, to see the specific area of the scalp being worked on. One attempt to avoid this visibility problem is to configure a working end of the hair clipper so that the bladeset, including a fixed or stationary blade, and a moving blade reciprocating laterally relative to the stationary blade, is movable relative to a main housing of the clipper. Many variations of hair clippers with pivoting bladesets are known in the art.

However, known hair clippers are provided where the work area is obscured by the bladeset to the extent where the stylist has difficulty viewing the work area making fine detail clipping difficult.

Thus, there is a need for an improved hair clipper in which the work area is easily visible to the stylist.

SUMMARY

The above-listed need is met or exceeded by the present hair clipper with a pivoting bladeset for enhanced user visibility. In the present clipper, the bladeset is oriented in an axially spaced location from a main housing. In addition, the blade set is pivotable relative to the main housing about an axis transverse to a longitudinal axis of the main housing. Further, the pivoting bladeset is adjustable between a variety of releasably locked angular positions. As such, the angle of attack of a cutting line defined by the reciprocating moving blade is movable to one of the lockable positions, each of which has a designated angular orientation relative to a plane extending transversely to a longitudinal axis of the main housing.

In the preferred embodiment, a releasable locking mechanism which may include a biased latch or locking member engages a corresponding landing surface for releasably locking the bladeset in a designated position. In a further preferred embodiment, the locking member is located on a cutting end of the housing, and the bladeset is provided with a blade chassis having a plurality of landings, each landing defining a corresponding landing surface previously mentioned, and each landing corresponding to a particular angular orientation of the bladeset.

More specifically, a hair clipper configured for enhanced user visibility is provided, including a clipper housing defining a longitudinal axis and a cutting end, a clipper bladeset operationally connected to the cutting end and including a stationary blade and a moving blade configured for reciprocating laterally relative to the stationary blade, a drive system projecting from the cutting end and operationally connected to the bladeset for reciprocating the moving blade relative to the stationary blade, at least one bladeset pivot support projecting from the cutting end and connected to the bladeset; the pivot support defining a pivot axis extending transverse to the longitudinal axis.

In an embodiment, a pair of the bladeset pivot supports extend from the cutting end, and define between them a mounting space for the bladeset. In another embodiment, the bladeset pivot supports extend generally parallel to the longitudinal axis. It is preferred that a releasable locking mechanism is provided, configured for releasably holding the bladeset in one of a plurality of designated operational rotated positions. A biased locking member is operationally associated with the bladeset for holding the bladeset in one of the designated operational positions. In an embodiment, a blade chassis is provided having a lobed cam member connected to, and pivoting with the bladeset, and having a locking surface defining a plurality of landings.

In a preferred embodiment, the cutting end of the housing is provided with a biased mechanical lock constructed and arranged for engaging a selected one of the landings. Also, the biased mechanical lock extends from the cutting end at an oblique angle to the longitudinal axis. Also, the plurality of landings defines angular orientations of a cutting line of the bladeset of 10°, 35° and 45° relative to a plane oriented transversely to the longitudinal axis.

In another embodiment, a hair clipper is configured for enhanced user visibility, and includes a clipper housing defining a longitudinal axis and a cutting end, a clipper bladeset operationally connected to the cutting end and including a stationary blade and a moving blade configured for reciprocating laterally relative to the stationary blade, a drive system projecting from the cutting end and operationally connected to the bladeset for reciprocating the moving blade relative to the stationary blade, a pair of bladeset pivot supports projecting from the cutting end and connected to the bladeset; the pivot supports defining a pivot axis extending transverse to the longitudinal axis, defining between them a mounting space for the bladeset, and a releasable locking mechanism is configured for releasably holding the bladeset in one of a plurality of designated operational rotated positions.

DETAILED DESCRIPTION

Figure 1:
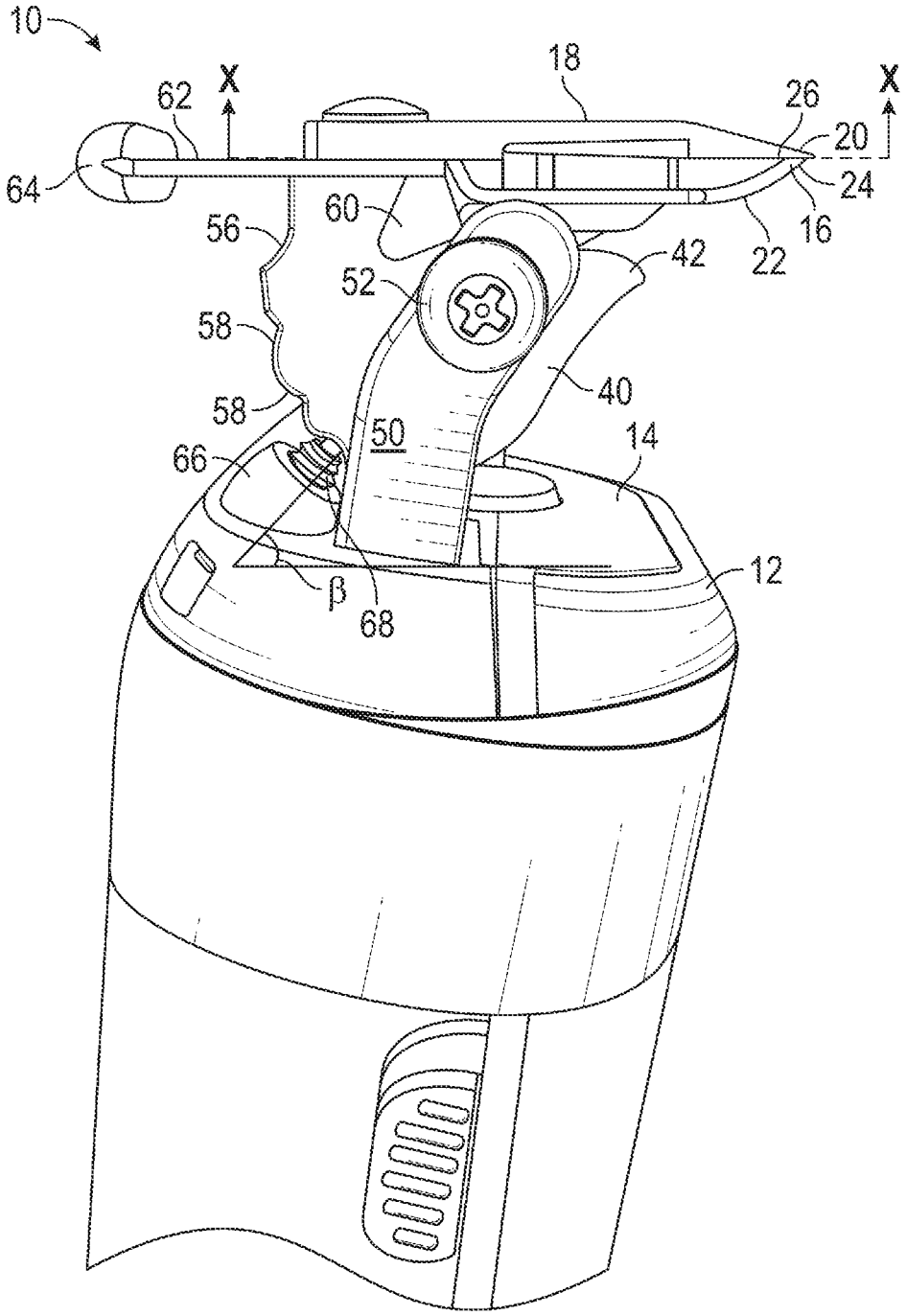
FIG. 1 is a side elevation of the present hair clipper in a first bladeset position.
Figure 2:
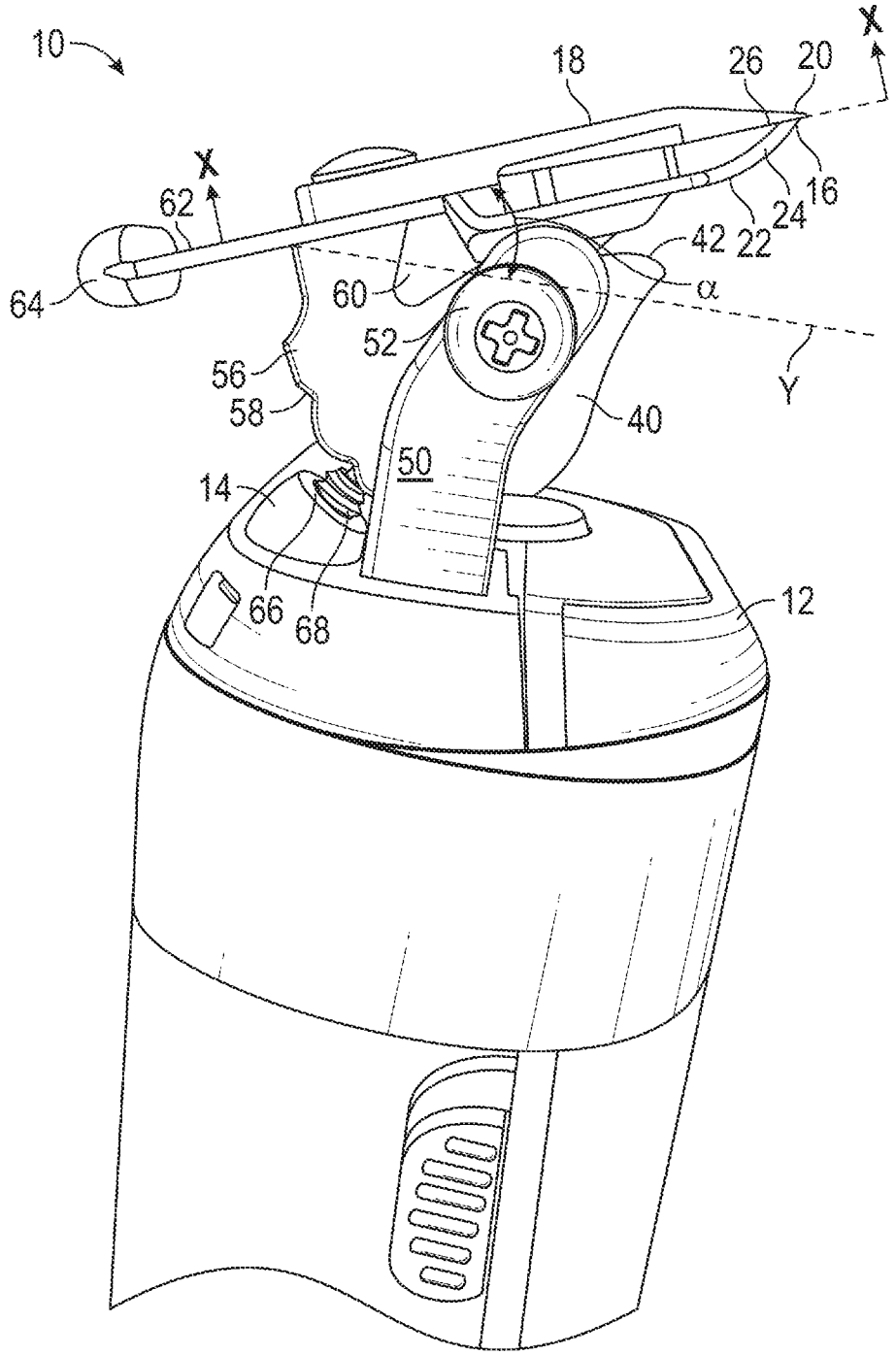
FIG. 2 is a side elevation of the present hair clipper in a second bladeset position.
Figure 3:
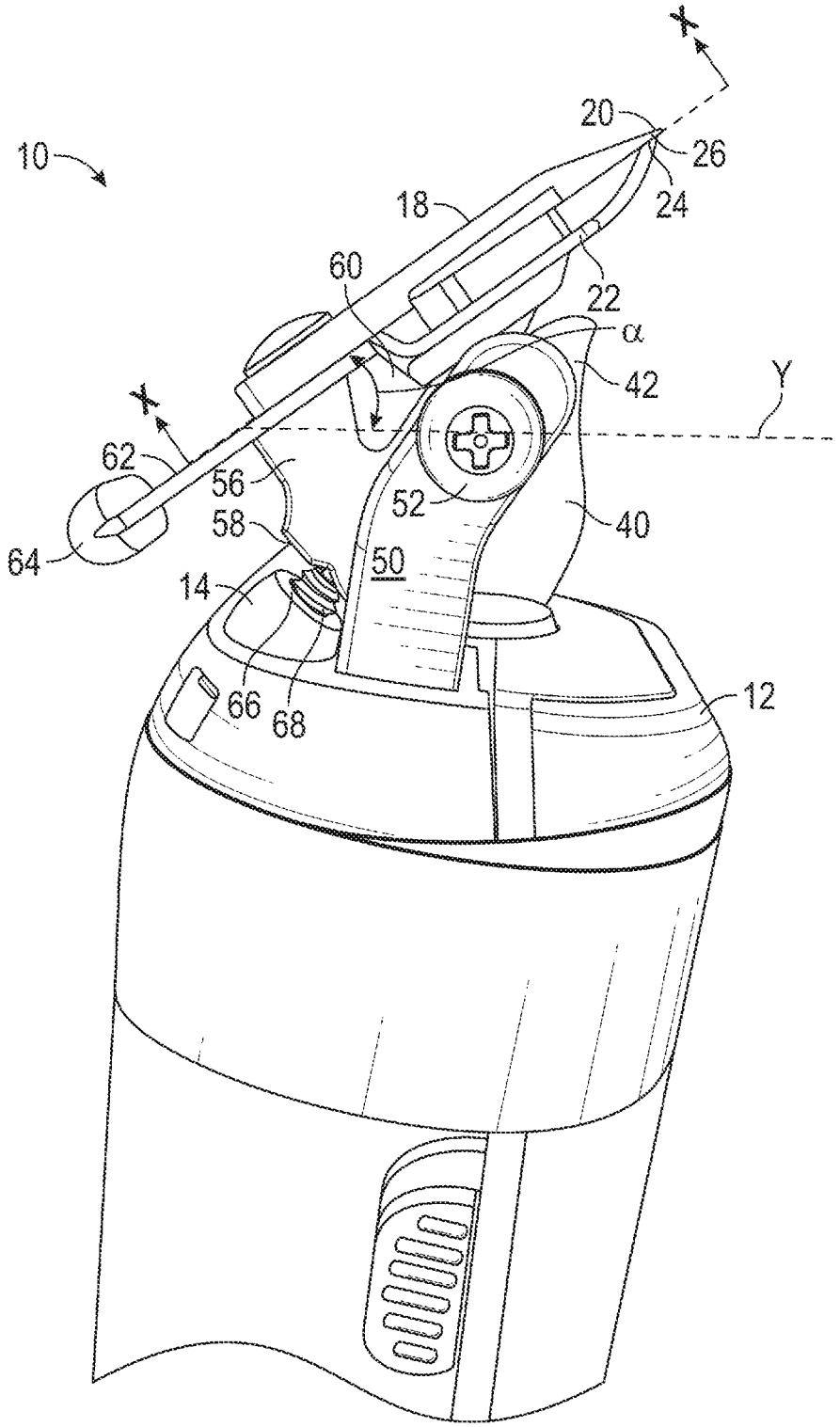
FIG. 3 is a side elevation of the present hair clipper in a third bladeset position.
Figure 4:
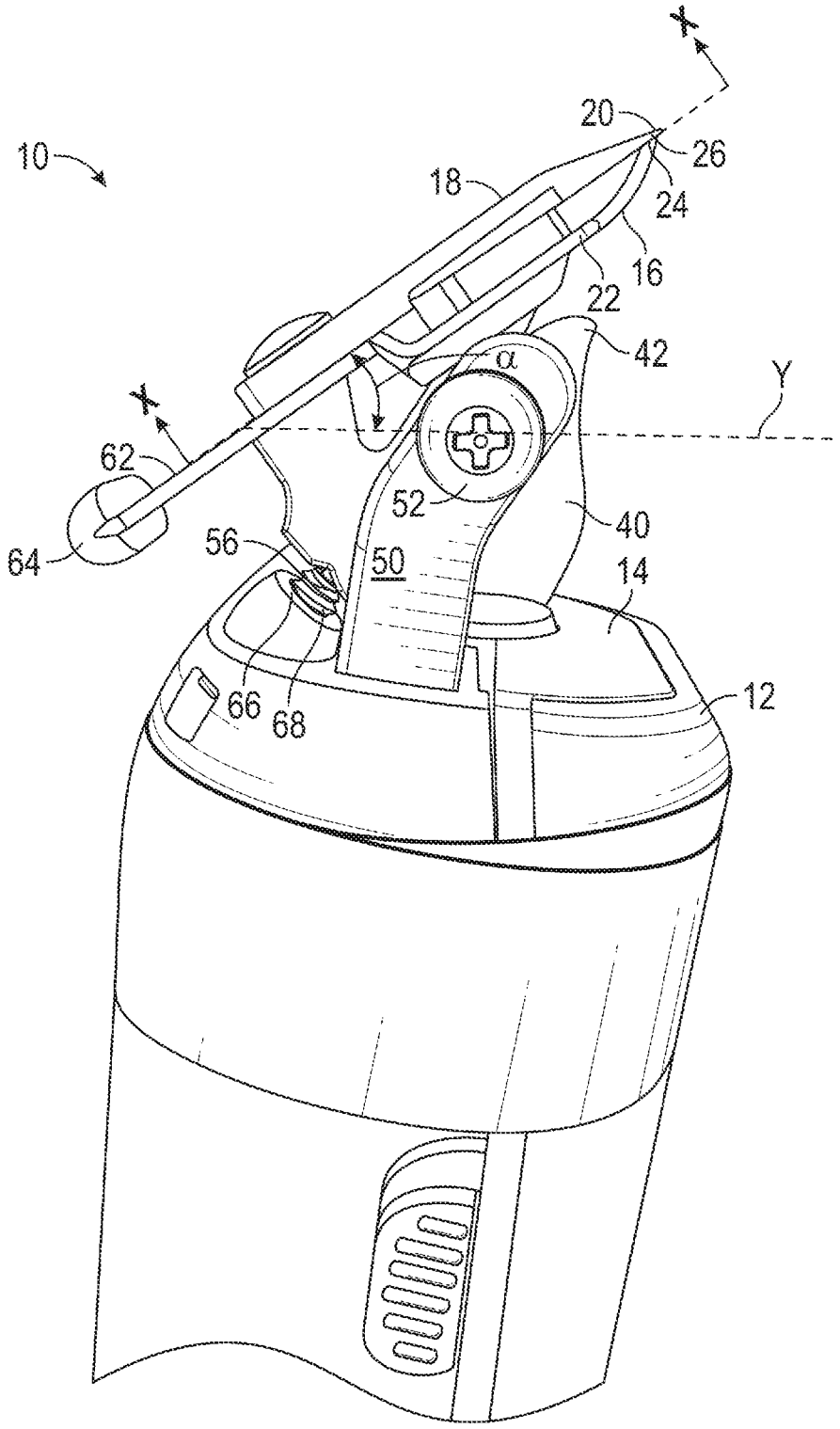
FIG. 4 is a side elevation of the present hair clipper in a fourth bladeset position.

Referring now to FIGS. 1-4, the present hair clipper is generally designated 10, and includes a clipper housing 12 which encloses, among other things a drive motor discussed below, electronic circuitry, an optional rechargeable battery (all not shown) which are well known to those of ordinary skill in the art. In the preferred embodiment, the housing 12 is provided in two opposing, clamshell-like halves, as is common in the industry. The housing 12 defines a longitudinal axis "L" (FIG. 5) and has a cutting end 14.

Included on the hair clipper 10 is a clipper bladeset 16, made up of a stationary blade 18 with a plurality of stationary blade teeth 20, and an opposing moving blade 22 having a plurality of moving blade teeth 24. A cutting line 26 is formed by the engagement of the teeth 20, 24 as the moving blade 22 is reciprocated laterally relative to the stationary blade.

Figure 5:
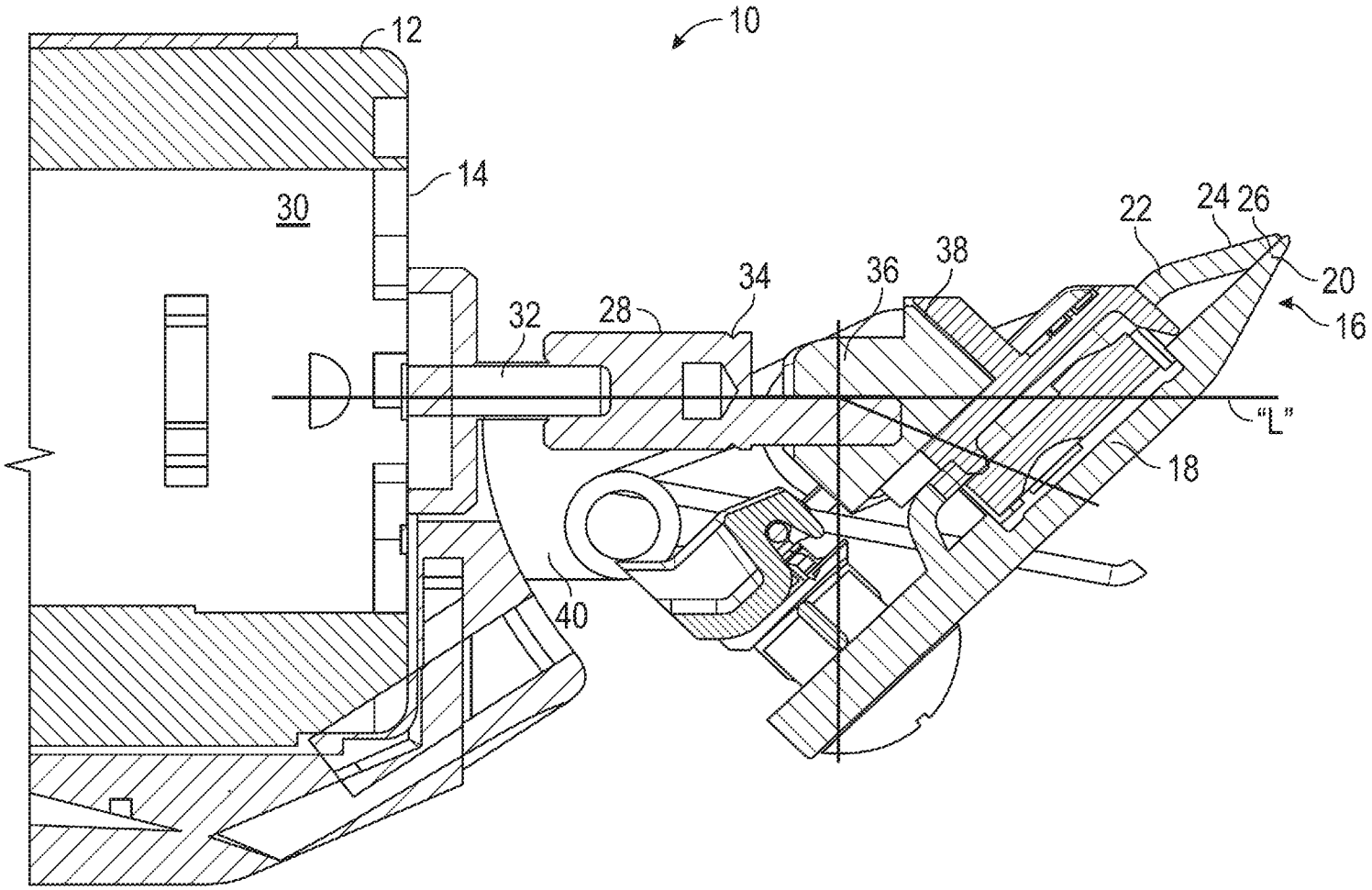
FIG. 5 is a fragmentary vertical section of the present hair clipper.
Figure 6:
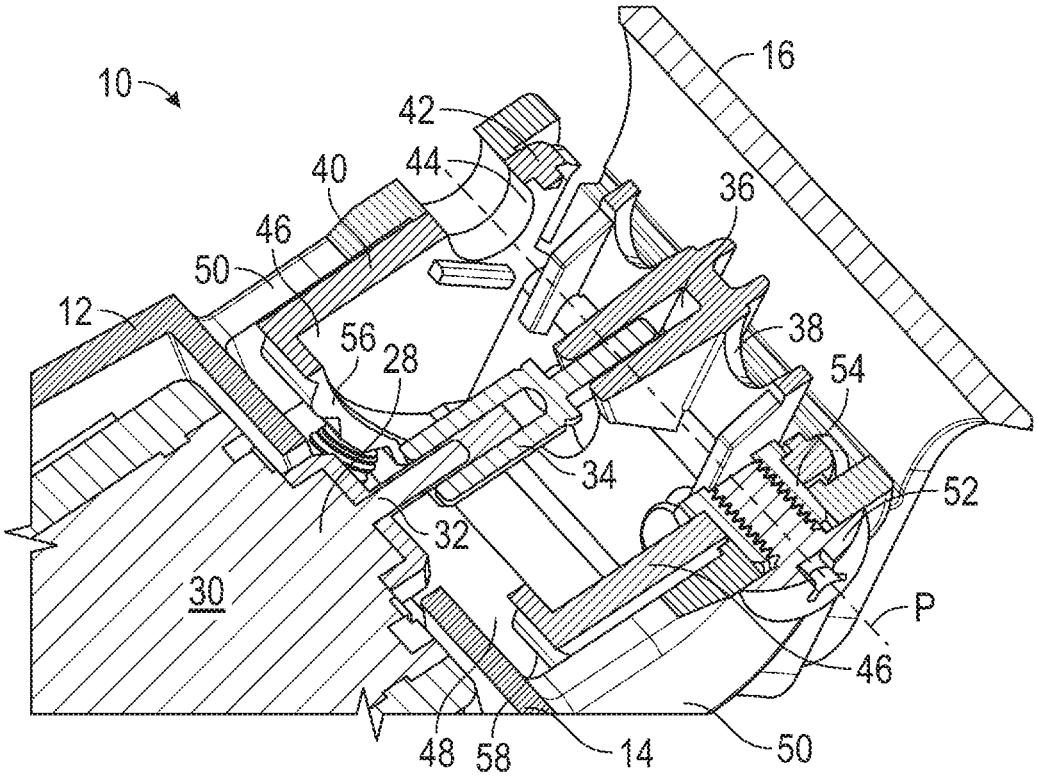
FIG. 6 is a fragmentary top view of the present hair clipper, with portions omitted for clarity.

Referring now to FIGS. 5 and 6, also included on the hair clipper 10 is a drive system 28, including the drive motor 30 having a motor driveshaft 32 which is connected to an eccentric cam pin 34 so that the rotary motion of the driveshaft is converted to linear motion as is well known in the art. A drive slot 36 in a cam follower 38 receives the cam pin 34. Attachment of the cam follower 38 to the moving blade 22 causes the moving blade to reciprocate laterally relative to the stationary blade 18 for creating cutting action, as is well known in the art.

The clipper bladeset 16 is secured to a blade chassis 40 which is generally wedge-shaped, with a pointed pivot end 42 having a transverse through bore 44, and a pair of sidewalls 46 that freely pivot within a mounting space 48 defined between a pair of bladeset pivot supports 50. At least one such support 50 is contemplated. The bladeset pivot supports 50 project from the cutting end 14 of the housing 12 and are connected to the bladeset 16 via the blade chassis 40. In the preferred embodiment, the bladeset pivot supports 50 project generally parallel to the longitudinal axis "L". The two pivot supports 50 define a pivot axis "P" (FIG. 6) in line with the throughbore 44 which is transverse to the longitudinal axis "L". Also, in the preferred embodiment, the pivot supports 50 have a dogleg shape, however other configurations are contemplated. Threaded fasteners 52, preferably screws or the like, each engage a flanged, preferably metal bushing 54 to rotatably fasten the blade chassis 40 to the bladeset pivot supports 50.

Returning to the blade chassis 40, opposite the pointed end 42 is a relatively wide, arcuate end 56 defining a locking surface or surfaces provided with at least one, and preferably a plurality of landings 58, which may be in the form of flats, detents, creases, etc., thereby defining a lobed cam member of the blade chassis 40 as described below. The arcuate end 56 is connected both to the sidewalls 46 and to an upper wall 60, which is secured to the bladeset 16. As is seen in FIG. 6, the wide end 56 optionally extends between and contacts both sidewalls 46, or optionally includes spaces in between the sidewalls. In the illustrated embodiment, each landing 58 is in the form of a recess or crease and is separated from its immediately adjacent landing(s) 58 by a lobed portion of the arcuate end 56. This alternating arrangement of landings 58 and lobed portions defines successive lobes of a lobed cam member arrangement.

Referring now to FIGS. 1-4, another feature of the blade chassis 40 is a handle 62 secured to the chassis and to the stationary blade 18, preferably by fasteners or the like. For facilitating user comfort, in the preferred embodiment, a resilient grip tab 64 is provided on the handle. The tab 64 is made of relatively soft, rubber-like material such as plastic or the like. Grasping of the tab 64 by the user facilitates movement of the bladeset 16 and the blade chassis 40 between designated positions determined by the landings 58. In the preferred embodiment, there are three landings 58, providing angular orientations of a cutting axis "X" of the bladeset 16 forming an angle $\alpha$ relative to a plane "Y" oriented transverse to the longitudinal axis "L". In the illustrated embodiment, longitudinal axis "L" is normal to plane "Y". In the preferred embodiment, $\alpha$ is 10°, 35° and 45° relative to the plane "Y" in FIGS. 2, 3, and 4, respectively. However, other angular orientations are contemplated depending on the application, which in turn is influenced, among other things, by the visibility needed by the user, the amount of obstruction caused by the bladeset 16, and the type of cut being performed. It will also be recognized from the teachings herein that the total number of discrete angular orientations possible is governed by the number of landings 58. Accordingly, the number of angular orientations described herein should be taken by way of example only.

In order to hold the bladeset 16 and the blade chassis 40 in one of the designated angular orientations, the present clipper 10 is provided with a releasable locking mechanism 66 configured for releasably holding said bladeset in one of a plurality of designated operational rotated positions through engagement with one of the landings 58. In the preferred embodiment, the locking mechanism 66 takes the form of a biased mechanical lock in the form of a biased locking member 68 such as a lug or pin spring or bar, as non-limiting examples, biased and operationally associated with the landings 58 on the bladeset 16 for holding the bladeset in one of the designated operational/angular positions. The releasable locking mechanism 66 is located between the pivot axis and the cutting end. Also, the locking member 68 is preferably mounted on the cutting end 14 of the housing 12 and positioned to engage a properly positioned landing 58. Further, the preferred locking member 68 is oriented to extend from the cutting end 14 at an oblique angle $\beta$ (FIG. 1) relative to a plane normal to the longitudinal axis "L" as is illustrated. As one non-limiting example, it is contemplated that the locking member 68 will be arranged and oriented to seat against each landing 58 such that the locking member 68 is generally perpendicular to that landing 58 to thereby achieve the maximum holding force. While a single locking member 68 is described, it will be readily recognized that more than one locking member 68 may be utilized and associated with a single arcuate surface, or respectively with multiple separate arcuate surfaces.

In operation, the user may manipulate the handle 62 to adjust the angular orientation of the bladeset 16. More specifically, the user may push or pull upon handle 62 to cause a corresponding torque about the pivot axis "P". As this occurs, a lobed portion between adjacent landings 58 will press against the locking member 68 to depress it and counteract the biasing force provided by the spring of the locking member 68. This continues until locking member 68 seats again in an adjacent landing.

While a particular embodiment of the present hair clipper with pivoting bladeset for enhanced user visibility has been described herein, it will be appreciated by those skilled in the art that changes and modifications may be made thereto without departing from the invention in its broader aspects and as set forth in the following claims.

The invention claimed is:

1. A hair clipper configured for enhanced user visibility, comprising:

a clipper housing defining a longitudinal axis and a cutting end;

a clipper bladeset operationally connected to said cutting end and including a stationary blade and a moving blade configured for reciprocating laterally relative to said stationary blade;

a blade chassis connected to said bladeset and being generally wedge-shaped, with a pointed end and an opposite arcuate end; and at least one bladeset pivot support projecting from said cutting end of said housing and connected to said bladeset via said blade chassis; said pivot support defining a pivot axis extending transverse to said longitudinal axis.

2. The hair clipper of claim 1, wherein said at least one bladeset pivot support includes a pair of said bladeset pivot supports extending from said cutting end, and defining between them a mounting space for said chassis.

3. The hair clipper of claim 2, wherein said bladeset pivot supports extend generally parallel to said longitudinal axis.

4. The hair clipper of claim 1, further including a releasable locking mechanism configured for releasably holding said bladeset in one of a plurality of designated operational rotated positions.

5. The hair clipper of claim 4, wherein the releasable locking mechanism includes a biased locking member operationally associated with said bladeset for holding said bladeset in one of said designated operational positions.

6. The hair clipper of claim 4, further including said blade chassis having a lobed cam member at said arcuate end, connected to, and pivoting with said bladeset, and having a locking surface defining a plurality of landings.

7. The hair clipper of claim 6, wherein said cutting end is provided with a biased mechanical lock constructed and arranged for engaging a selected one of said landings.

8. The hair clipper of claim 7, wherein said biased mechanical lock extends from said cutting end at an oblique angle to said longitudinal axis.

9. The hair clipper of claim 6, wherein said plurality of landings define angular orientations of a cutting axis of said bladeset of 10°, 35° and 45° relative to a plane oriented transversely to said longitudinal axis.

10. A hair clipper configured for enhanced user visibility, comprising:

a clipper housing defining a longitudinal axis and a cutting end;

a clipper bladeset operationally connected to said cutting end and including a stationary blade and a moving blade configured for reciprocating laterally relative to said stationary blade;

a blade chassis connected to said bladeset and being generally wedge-shaped, with a pointed end and an opposite arcuate end;

at least one bladeset pivot support projecting from said cutting end of said housing and connected to said bladeset by engagement on opposite sides of said blade chassis; said pivot support defining a pivot axis extending transverse to said longitudinal axis;

said at least one bladeset pivot support comprising a pair of said bladeset pivot supports extending from said cutting end of said housing, and defining between them a mounting space for said blade chassis;

a releasable locking mechanism configured for releasably holding said bladeset in one of a plurality of designated operational rotated positions.

11. The hair clipper of claim 10, wherein said releasable locking mechanism is located between said pivot axis and said cutting end.

12. The hair clipper of claim 10, further including said blade chassis having a lobed cam member at said arcuate end, connected to, and pivoting with said bladeset, and having a locking surface defining a plurality of landings.

13. The hair clipper of claim 12, wherein said releasable locking mechanism is a biased mechanical lock constructed and arranged for engaging a selected one of said landings.

14. The hair clipper of claim 10, wherein said bladeset pivot supports each have a dogleg configuration for enhancing user visibility of said bladeset.

* * * * *